United States Patent [19]

Spiro

[11] Patent Number: 4,546,925

[45] Date of Patent: Oct. 15, 1985

[54] SUPERMICRONIZED PROCESS FOR COAL COMMINUTION

[75] Inventor: Clifford L. Spiro, Scotia, N.Y.

[73] Assignee: General Electric Company, Schenectady, N.Y.

[21] Appl. No.: 530,179

[22] Filed: Sep. 9, 1983

[51] Int. Cl.[4] ..... B02C 19/00

[52] U.S. Cl. ..... 241/1; 241/5; 241/29

[58] Field of Search ..... 209/5; 241/29, 15, 16, 241/1, 5, 30, 39; 44/51

[56] References Cited

U.S. PATENT DOCUMENTS

| | | | |
|---|---|---|---|
| 1,681,335 | 8/1928 | Griessbach et al. | 241/1 X |
| 2,846,150 | 8/1958 | Work | 241/5 |
| 3,614,000 | 10/1971 | Blythe | 241/5 |
| 3,815,826 | 6/1974 | Aldrich et al. | 241/1 |
| 3,850,477 | 11/1975 | Aldrich et al. . | |
| 3,870,237 | 3/1975 | Aldrich | 241/1 |
| 4,045,092 | 8/1977 | Keller | 44/51 X |
| 4,102,812 | 7/1978 | Robinson et al. | 241/1 X |
| 4,412,839 | 11/1983 | Taylor . | |

FOREIGN PATENT DOCUMENTS

| | | | |
|---|---|---|---|
| 26574 | 4/1981 | European Pat. Off. | 241/15 |

OTHER PUBLICATIONS

I.G.C. Dryden, "Solvent Power for Coals at Room Temperature Chemical and Physical Factors", Chemistry and Industry (Jun. 7, 1952), pp. 502–508.

D. Brenner, "Solvent-Induced Swelling of Thin Sections of Coal", Corporate Research Science Laboratories, Exxon Research and Engineering Company, pp. 244–253.

*Primary Examiner*—Mark Rosenbaum

*Attorney, Agent, or Firm*—Lawrence D. Cutter; James C. Davis, Jr.; Marvin Snyder

[57] ABSTRACT

Coal particles, typically having a particle diameter below approximately one micron, are produced by mechanical fracturing, the addition of a swelling agent, the further mechanical fracturing and removal of the swelling agent. In particular, gaseous anhydrous ammonia is employed as the entrainment fluid and swelling agent in a fluid energy mill for coal comminution.

20 Claims, 2 Drawing Figures

SUPERMICRONIZED PROCESS FOR COAL COMMINUTION

BACKGROUND OF THE INVENTION

The present invention is related to methods for producing coal particles having particle sizes in the range of one micron and below. In particular, the present invention is directed to the use of swelling agents which are subsequently removed from fractured coal particles so as to further reduce their post-fracture size distribution.

The utilization of coal as an energy resource appears to be more and more desirable as the supply of other fossil fuels, such as oil, is depleted. However, the utilization of coal in various energy processes often requires the removal of mineral matter from the raw coal. If such mineral matter is not removed, corrosion, fouling, erosion and environmental hazards can be associated with certain coal utilization processes. One of the methods for removing undesirable mineral matter from coal is the grinding of coal to smaller and smaller particle sizes. This means that smaller and smaller occluded and clathrated indigenous mineral particles can be released. However, the smaller the particle size distribution that is desired, the more time and energy is required to produce such particles. Existing methods for grinding coal have reached a particle size limit of approximately one micron. Since mineral matter occurs to significant degrees in sub-micron sized coal particles, producing sub-micron sized coal particles is a necessary prerequisite to the mechanical or other removal of undesired mineral contaminants.

Several mechanical methods to grind coal presently exist. These include fluid energy mills, ball mills, stirred ball mills, hammer mills, and the like. See, for example, the "Department of Energy Coal Grinding Task Group, Final Report" by W. Bunker, W. Siskind, J. Nardella, K. Sommer, and D. Stueve, available from the Assistant Secretary for Fossil Energy, Division of Coal Utilization Systems, Washington, D.C. 20545, June, 1982. This article reviews several mechanical methods for coal comminution.

Most germane to the present invention is the utilization of fluid energy mills consisting of an annular fluid mill, a jet-vortex mill, and an opposed-jet mill configuration also reviewed in the abovementioned Final Report. In general, these mills use air, steam or nitrogen to accomplish entrainment of coal particles which in turn collide against one another and the vessel walls to fragment to particle sizes in the range of one micron and above. However, this technology is limited in that once a critical particle size is reached, the particles tend to be entrained in the exit gas stream. Furthermore, as the particle size is reduced, the probability of collision and the energy of collision and the friability of coal particles is reduced. Accordingly, it is seen that present fluid milling methods for coal comminution are inherently limited. Nonetheless, the desire to produce sub-micron sized coal particles remains.

Additionally, the use of chemical agents to accomplish coal swelling in coal comminution is also known. See, for example, U.S. Pat. No. 3,870,237; U.S. Pat. No. 3,815,826; and U.S. Pat. No. 3,850,477 all of which issued to Aldrich et al. In this respect see also the article by I. G. C. Dryden, pp. 502–8 of the 1952 issue of "Chemistry and Industry", June 7, 1952. Furthermore, the microscopic reversibility of coal swelling processes has very recently been demonstrated as is discussed in a preprint of an article for the American Chemical Society Fuel Division by D. Brenner Volume 27 (Issues 3–4), page 244 (1982). However, the use of chemical agents to accomplish coal swelling and coal comminution have not heretofore been employed for the production of sub-micron sized coal particles. More particularly, chemical swelling agents have not been employed as entrainment fluids for fluid energy mills. Accordingly, while chemical and mechanical methods have been employed to produce coal particle sizes in the range of one micron and above, they have not heretofore been employed in a cooperative manner to produce sub-micron sized coal particles from which undesirable mineral species may be more readily removed. Such removal is nonetheless highly desirable for the production of coal for use in direct coal fired diesel engines, turbines, or as chemical feedstocks.

SUMMARY OF THE INVENTION

In accordance with a preferred embodiment of the present invention, a swelling agent is employed as an entrainment fluid for a fluid milling coal fracturing process. In accordance with another preferred embodiment of the present invention, coal is first mechanically fractured to a first range of particle sizes following which a swelling agent is added to the fractured coal to increase the particle sizes and the coal is then further mechanically fractured, in the swelled state, following which the swelling agent is removed so as to reduce the coal particle size to a range below approximately one micron. In the present invention the swelling agent may be added at any one of several steps in the fracturing process.

Accordingly, it is an object of the present invention to produce sub-micron sized coal particles.

It is another object of the present invention to produce coal particles from which undesirable mineral matter may be readily removed.

It is also an object of the present invention to produce readily cleanable coal.

It is still another object of the present invention to increase the efficiency of fluid energy mills for coal comminution through the use of an entrainment fluid comprising a coal swelling agent.

It is yet another object of the present invention to produce coal which may be employed in diesel engines, turbines, or used as chemical feedstocks.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings, in which:

DETAILED DESCRIPTION OF THE INVENTION

Figure 1:
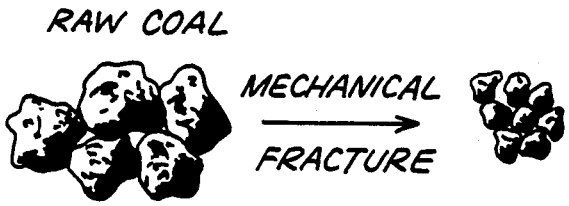
FIG. 1 (PRIOR ART)
FIG. 1 is a schematic diagram illustrating conventional mechanical fracturing processes.
Figure 2:
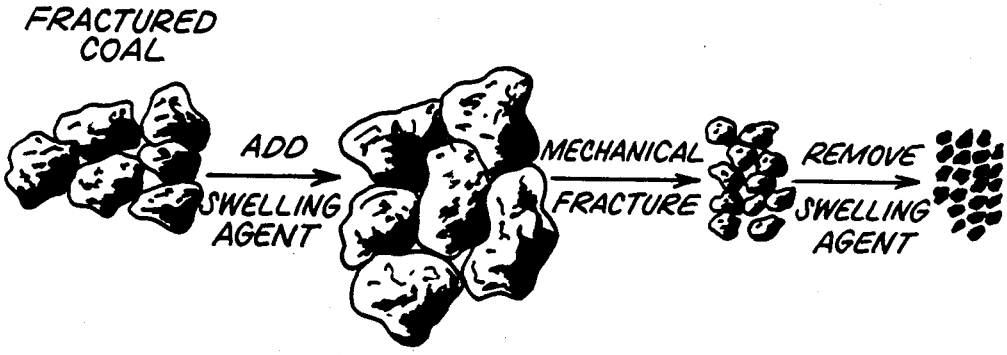
FIG. 2 is a schematic diagram illustrating one embodiment of the present invention.

As illustrated in FIG. 1, raw coal of various sizes is subjected to mechanical fracturing such as in ball or hammer mills to reduce the particle size. Typically, several mechanical fracturing steps are employed. Conventional grinding methods typically produce coal particles having a diameter of about 60 microns. Further processing by ball milling or hammer milling can reduce the particle size somewhat. Stirred ball milling and fluid milling may also be employed as mechanical fracturing process steps but, as indicated above, these methods typically do not produce substantial amounts of coal particles with a diameter less than about one micron. At this particle size conventional processes require increasingly large amounts of time and energy to further reduce the particle size, and even if they could be employed for such reduction, the efficiency of these processes would decrease with the average size of the particle produced.

However, the problems associated with conventional processes are greatly ameliorated by the present invention. In particular, in the present invention raw coal is mechanically fractured to a first range of particle sizes, typically in the range of about ten to about 100 microns. At this point, the swelling agent is added to the fractured coal to initially increase the particle size. Following this further mechanical fracturing is performed to reduce the coal particle size to approximately that particle size which it possessed prior to the addition of the swelling agent. The swelling agent is then removed from the coal particles causing them to shrink to particle sizes not readily achievable through conventional mechanical fracturing processes alone.

In preferred embodiments of the present invention the first mechanical fracturing of the raw coal is typically accomplished by means of ball or hammer milling. In such cases the swelling agent is added in a conventional fashion. However, in that situation in which mechanical fracturing is accomplished by fluid milling processes, it is preferable to actually entrain coal particles within a gaseous swelling agent, such as anhydrous ammonia. In this case in particular, the swelling agent is to be added prior to the mechanical fracturing process. Nonetheless, in the present specification and the appended claims, the fluid milling process is nonetheless considered to be a mechanical fracturing process, as is ball milling, stirred ball milling, hammer milling, grinding, and the like.

The swelling agents employed in the present invention include such material as ammonia, methyl amines, ethyl amines, alkyl amines, chloroform, pyridine and tetra-alkyl ammonium hydroxides. The actual swelling agent employed may in fact depend upon type and composition of the raw coal employed. It is also desirable that the swelling agent does not adversely affect the friability of the coal particles. Ammonia in particular has been found to positively affect the brittleness of the coal. This is particularly important in fluid milling processes since if the coal particles are excessively soft, there is an increase in the probability for elastic, rebounding collisions in which fracturing does not occur.

The swelling agent may be removed from the finally fractured coal product in a variety of ways. For example, the swelling agent may be removed by heating the swelled coal. The swelling agent may also be removed by vacuum drying the swelled coal. Additionally, air drying or solvent replacement may be employed. For example, water may be employed to replace the swelling agent in the coal particles. Following this replacement, the coal particles shrink to a particle size not readily achievable through mechanical fracturing alone. In particular, with respect to the use of anhydrous ammonia as a swelling agent, it is found that swelling agent removal may be accomplished by simply letting the finally treated coal particles stand in open containers to effect removal of the included ammonia.

In particular, in the present invention it is seen that gaseous anhydrous ammonia is a preferred entrainment gas for use in fluid milling devices. The ammonia is reasonably inexpensive, gaseous at ambient conditions and is known to swell coals by up to a factor of 10. Furthermore, it is found that this swelling is reversible. Thus the coal may be ground as before in a fluid energy mill of essentially the same configuration as previously employed with only minor modifications to accomodate the unique properties of the fluid. That is, the fluid mill, employing ammonia as an entrainment fluid, should comprise materials which are relatively inert with respect to the ammonia gas. In such fluid milling processes, the gas phase of the swelling agent is required to be present in the coal itself.

From the above, it should be appreciated that the present invention overcomes many of the problems associated with coal comminution. In particular, it is seen that substantially smaller coal particle sizes may be produced with little additional expenditure in energy, efficiency or time. It is also further seen that the swelling agent may be recovered and may be reused for further coal processing. It is also seen that anhydrous ammonia is a preferably employable swelling agent which offers advantages for swelling agent removal in that it is seen to be reversibly removable from coal under relatively simple conditions such as exposure for a length of time to atmospheric conditions. However, for purposes of ammonia recovery, the removal process may be hastened by employing techniques such as vacuum drying. It is further seen that the swelling agent may be selected in dependence on the particular coal type employed. It is also seen that the swelling agent may be selected to increase the brittleness of the coal particles.

While the invention has been described in detail herein in accord with certain preferred embodiments therof, many modifications and changes therein may be effected by those skilled in the art. Accordingly, it is intended by the appended claims to cover all such modifications and changes as fall within the true spirit and scope of the invention.

The invention claimed is:

1. A method for comminution of raw coal to produce coal particles having particle sizes in the range of one micron and below comprising:

mechanically fracturing said coal to a first range of particle sizes;

adding a swelling agent to said fractured coal so as to increase the size of said coal particles;

further mechanically fracturing said swelled coal particles;

removing said swelling agent from said fractured coal so as to further reduce the particle size range of said coal.

2. The method of claim 1 in which said first mechanical fracturing step is performed by fluid milling.

3. The method of claim 1 in which said swelling agent removal is performed by heating said swelled coal.

4. The method of claim 1 in which said swelling agent removal is performed by vacuum drying said swelled coal.

5. The method of claim 1 in which said swelling agent removal is performed by air drying said swelled coal.

6. The method of claim 1 in which said swelling agent removal is performed by replacement of said swelling agent with material species not possessing coal swelling properties.

7. The method of claim 1 in which said swelling agent is selected from the group consisting of ammonia, methyl amines, ethyl amines, alkyl amines, chloroform, pyridine, and tetra-alkyl ammonium hydroxides.

8. The method of claim 1 in which said further fracture is performed by fluid milling.

9. The method of claim 1 in which said further fracture is performed by ball milling.

10. The method of claim 1 in which said further fracture is performed by stirred ball milling.

11. The method of claim 1 in which said swelling agent is retained within said coal particles in a gas phase.

12. The method of claim 1 in which said swelling agent is selected so as to increase coal particle brittleness.

13. The method of claim 1 in which said first fracturing step is performed by ball milling.

14. The method of claim 1 in which said first fracturing step is performed by hammer milling.

15. The method of claim 1 in which said first range of particle sizes is between approximately 100 microns and approximately ten microns.

16. The method of claim 1 in which said further mechanical fracture of said coal produces coal particle sizes below approximately one micron.

17. A method for comminution of raw coal to produce coal particles having particle sizes in the range of one micron and below comprising:

adding a swelling agent to said raw coal so as to increase the size of said coal;

mechanically fracturing said coal;

removing said swelling agent from said fractured coal so as to further reduce the particle size range of said coal.

18. The method of claim 17 further comprising the steps of adding a swelling agent to said fractured coal and then further mechanically fracturing said swelled coal.

19. A method for coal to produce coal particles having particle sizes in the range of one micron and below comminution comprising the steps of:

mechanically fracturing coal particles in a fluid mill employing a coal swelling agent as an entrainment fluid;

removing said swelling agent from said fractured coal so as to further reduce the particle size range of said coal.

20. The method of claim 19 in which said swelling agent comprises ammonia.

* * * * *